US009947500B2

(12) United States Patent
Pan et al.

(10) Patent No.: US 9,947,500 B2
(45) Date of Patent: Apr. 17, 2018

(54) GROUND FAULT CIRCUIT INTERRUPTER

(71) Applicant: Ze Chen, Yueqing, Zhejiang Province (CN)

(72) Inventors: Xincheng Pan, Huizhou (CN); Tingting Wu, Wenzhou (CN); Ye Zhang, Huizhou (CN)

(73) Assignee: Ze Chen (CN)

( * ) Notice: Subject to any disclaimer, the term of this patent is extended or adjusted under 35 U.S.C. 154(b) by 0 days.

(21) Appl. No.: 15/426,459

(22) Filed: Feb. 7, 2017

(65) Prior Publication Data

US 2017/0148599 A1 May 25, 2017

Related U.S. Application Data

(63) Continuation of application No. 15/049,321, filed on Feb. 22, 2016, now Pat. No. 9,601,289.

(30) Foreign Application Priority Data

Jun. 4, 2015 (CN) ..... 2015 2 0378477 U

(51) Int. Cl.

| | |
|---|---|
| ***H01H 83/00*** | (2006.01) |
| ***H01H 83/02*** | (2006.01) |
| ***H01H 50/04*** | (2006.01) |
| ***H01H 50/54*** | (2006.01) |

(52) U.S. Cl.

CPC ..... *H01H 83/02* (2013.01); *H01H 50/048* (2013.01); *H01H 50/54* (2013.01)

(58) Field of Classification Search

CPC ..... H01H 83/04

USPC ..... 335/18

See application file for complete search history.

(56) References Cited

U.S. PATENT DOCUMENTS

| | | | | |
|---|---|---|---|---|
| 4,001,652 | A | 1/1977 | Klein | |
| 4,412,193 | A * | 10/1983 | Bienwald | H01H 73/44 335/18 |
| 4,831,496 | A * | 5/1989 | Brant | H01H 83/04 361/730 |
| 5,541,800 | A | 7/1996 | Misencik | |
| 6,199,264 | B1 * | 3/2001 | Marcou | H01R 13/6666 29/593 |
| 6,828,886 | B2 | 12/2004 | Germain | |

(Continued)

FOREIGN PATENT DOCUMENTS

CN 201210024531.5 2/2012

*Primary Examiner* — Alexander Talpalatski

(74) *Attorney, Agent, or Firm* — Mei & Mark LLP

(57) ABSTRACT

A ground fault circuit interrupter includes a reset key, a reset mechanism, a conductive assembly configured to connect a power supply input side to a load side, a leakage signal detection circuit, and an electromagnetic tripping mechanism. The reset mechanism comprises a reset support and a support return mechanism. The reset support comprises a reset bracket and a support reset spring. The support return mechanism comprises a reset pole, a reset key spring, a compression spring, a reset block, a compression spring container, a reset slider, and a contact conductive part. The contact conductive part is disposed at a lower end of the reset slider and is configured to align with a position of a switch contact on a first PCB board. A state of contact or separation between the contact conductive part and the switch contact is configured to control an on-off state of the conductive assembly.

20 Claims, 5 Drawing Sheets

(56) References Cited

U.S. PATENT DOCUMENTS

| | | | | |
|---|---|---|---|---|
| 6,954,125 | B2 | 10/2005 | Wu | |
| 7,265,956 | B2 * | 9/2007 | Huang | H01H 83/04 335/18 |
| 7,317,600 | B2 * | 1/2008 | Huang | H01H 71/123 335/18 |
| 7,576,959 | B2 * | 8/2009 | Huang | H01H 83/04 361/42 |
| 7,889,466 | B2 | 2/2011 | Chan | |
| 7,936,238 | B1 | 5/2011 | Weeks | |
| 8,233,251 | B2 * | 7/2012 | Huang | H01H 83/04 335/21 |
| 8,335,062 | B2 | 12/2012 | Haines | |
| 8,462,006 | B2 | 6/2013 | Chen | |
| 8,779,875 | B2 * | 7/2014 | Chen | H01H 73/44 335/18 |
| 8,847,712 | B2 * | 9/2014 | Chen | H01H 83/04 335/18 |
| 9,437,386 | B2 * | 9/2016 | Weeks | H02H 3/06 |
| 2004/0070474 | A1 | 4/2004 | Wu | |
| 2005/0063109 | A1 | 3/2005 | Baldwin | |
| 2007/0030608 | A1 | 2/2007 | Baldwin | |
| 2007/0279814 | A1 | 12/2007 | Bonilla | |
| 2008/0002314 | A1 | 1/2008 | Batko | |
| 2009/0086390 | A1 * | 4/2009 | Huang | H01H 83/04 361/49 |
| 2009/0161271 | A1 * | 6/2009 | Huang | H01H 83/04 361/42 |
| 2010/0254049 | A1 | 10/2010 | Yue | |
| 2010/0259347 | A1 | 10/2010 | Ziegler | |
| 2013/0241678 | A1 * | 9/2013 | Bonasia | H01H 83/04 335/18 |
| 2014/0285939 | A1 | 9/2014 | Chen | |
| 2015/0333498 | A1 * | 11/2015 | Weeks | H02H 3/06 361/42 |

* cited by examiner

GROUND FAULT CIRCUIT INTERRUPTER

CROSS-REFERENCE TO RELATED APPLICATION

This application is a continuation of co-pending U.S. patent application Ser. No. 15/049,321, filed on Feb. 22, 2016, the disclosure of which is incorporated by reference in its entirety, and which claims priority to and incorporates herein Chinese Application No. 201520378477.3, filed on Jun. 4, 2015.

TECHNICAL FIELD

The disclosure relates to a ground fault circuit interrupter.

BACKGROUND

A ground fault circuit interrupter (GFCI) is a leakage protection product widely used in North American and South American countries/regions such as United States and Canada. It plays an important role in protecting safety of lives and property of the people in the aforementioned areas.

For example, Chinese Patent Application No. 201210024531.5 (filed on Feb. 4, 2012), U.S. Pat. No. 8,779,875 (issued Jul. 15, 2014), and U.S. Pat. No. 8,847,712 (issued Sep. 30, 2014) disclose a socket-type ground fault circuit interrupter. The contents of these prior art documents are incorporated by reference. As shown in FIGS. 1-3, which are based on those prior art references, a ground fault circuit interrupter may include a shell (not shown in the drawings), a reset key 4, a reset mechanism disposed in the shell, a conductive assembly connecting a power supply input side to a load side; a leakage signal detection circuit, and an electromagnetic tripping mechanism whose action is controlled by the leakage signal detection circuit. The reset mechanism includes a reset support and a support return mechanism. The reset support includes a reset bracket 12 and a support reset spring 13 disposed in the reset bracket 12. The support return mechanism includes a reset pole 14, a reset key spring 17, a compression spring 24, a reset block 21, a compression spring container 220 in the reset block 21, and a reset slider 22. The reset slider 22 is disposed adjacent to and is configured to engage with the reset bracket 12.

As controlled by the reset key 4, the support return mechanism, and the electromagnetic tripping mechanism, the reset support has a first position in a reset (closed) state and a second position in a tripping (open) state. In the first position, support reset spring 13 is compressed and electrical contacts of reset bracket 12 are pressed against corresponding electrical contacts of other GFCI components (as explained in the referenced art), which permits electrical connection of the conductive assembly from a power supply input side to a load side. In the second position, support reset spring 13 is able to push reset bracket 12 such that electrical contacts of reset bracket 12 are separated from corresponding electrical contacts of the other GFCI components, thereby preventing electrical connection of the conductive assembly. The support return mechanism works in coordination with the reset support, such that the reset support is biased to slide from the first position to the second position due to the force of support reset spring 13.

As discussed in the referenced art, the reset support and support return mechanisms work as follows: From a tripped stated, when the reset key 4 is pressed, the reset pole 14 moves downward (i.e., away from the reset key 4). Provided that adequate downward pressure is provided to the reset key 4, the reset pole 14 moves downward, compressing compression spring 24, and bringing a reset locking hook 403 at the lower end of the reset pole 14 into alignment with a linkage hole 143 on the reset slider 22. Upon such alignment, an iron core 151 of the electromagnetic tripping mechanism may engage with both the reset locking hook 403 and the linkage hole 143 via an iron core reset spring 153 (not show). Engagement of the iron core 151 serves to lock the reset pole 14 and the reset slider 22 together, along with reset block 21.

Additionally, when reset key 4 is sufficiently pressed, the downward-most end of reset pole 14 is passed through a hole of a first PCB board 61, thereby separating a leaf switch 18 from a contact on the first PCB board 61 and disconnecting the leaf switch 18. As this leaf switch 18 may control an on-off state of electrical connection of the conductive assembly from a power supply input side to a load side, the provision of power supply is prevented while the reset key 4 is fully depressed. Once the reset key 4 is no longer pressed downward, key reset spring 17 returns reset key 4 to its original position, consequently pulling the downward-most end of reset pole 14 back through the hole of the first PCB board 61 and permitting the leaf switch 18 to reconnect.

As discussed in the referenced art, when the reset sliding block 22 is locked to reset pole 14 (and reset block 21) via an iron core 151 of an electromagnetic tripping mechanism and after reset key 4 is no longer being pressed, the support return mechanism moves upward due to the force of reset key spring 17 and reset sliding block 22 presses against reset bracket 12, maintaining the reset support in the first position.

When the electromagnetic tripping mechanism is tripped, the iron core 151 of the electromagnetic tripping mechanism is withdrawn, thereby unlocking reset pole 14 and reset slider 22 (and reset block 21) from one another. This unlocking allows bracket reset spring 13 to push reset bracket 12 further in the direction of the support return mechanism, which disconnects the electrical contacts of reset bracket 12 and returns the reset support to the second (open) position. Under the force of the compression spring 24 and bracket reset spring 13 (transferred via corresponding inclined surfaces of reset bracket 12 and reset sliding block 22), the reset slider 22 and the reset block 21 both separate from one another and move away from the reset key 4 along the reset pole 14.

The above-described existing ground fault circuit interrupter has the following structural disadvantages. First, a leaf switch having a complex structure is required in order to permit a reset mechanism is to drive the leaf switch to control the on-off state of the conductive assembly. This increases the quantity of complex parts in the ground fault circuit interrupter, which increases the manufacturing cost of the ground fault circuit interrupters.

Second, the above-described ground fault circuit interrupter requires that the leaf switch 18 be disposed on a side of the PCB board opposite from the bulk of the components of the ground fault circuit interrupter. This causes the ground fault circuit interrupter to inefficiently utilize space and prevents the ground fault interrupter from being compact in structure.

SUMMARY

An objective of the present disclosure is to provide to a ground fault circuit interrupter that overcomes one or more of the structural disadvantages of the existing ground fault circuit interrupters described above.

In one example, a ground fault circuit interrupter is provided. The ground fault circuit interrupter includes a reset key, a reset mechanism, a conductive assembly configured to connect a power supply input side to a load side, a leakage signal detection circuit, and an electromagnetic tripping mechanism configured to be controlled by the leakage signal detection circuit. The reset mechanism comprises a reset support and a support return mechanism. The reset support comprises a reset bracket and a support reset spring disposed in the reset bracket. The support return mechanism comprises a reset pole, a reset key spring, a compression spring, a reset block, a compression spring container, a reset slider, and a contact conductive part. The reset support has a first position in a reset state and a second position in a tripping state. The support return mechanism is engaged with the reset support such that the reset support is biased to slide from the first position to the second position. The contact conductive part is disposed at a lower end of the reset slider and is configured to align with a position of a switch contact on a first PCB board. A state of contact or separation between the contact conductive part and the switch contact is configured to control an on-off state of the conductive assembly.

In another example, the contact conductive part is a conductive strip embedded at the lower end of the reset slider.

In yet another example, the contact conductive part is a conductive strip pasted at the lower end of the reset slider.

In yet other examples, the ground fault circuit interrupter further includes a second PCB board. The second PCB board is positioned substantially parallel to the first PCB board on the opposite side of the first PCB board upon which the switch contact is disposed.

In yet other examples, the ground fault circuit interrupter further includes plug-in unit. The plug-in unit connects the second PCB board and the first PCB board.

In yet other examples, the plug-in unit is disposed on the first PCB board. The plug-in unit includes a pin. The second PCB board includes a plug-in hole configured to correspond with the pin of the plug-in unit. The second PCB board is attached to the plug-in unit via insertion of the pin into plug-in hole.

In yet other examples, the plug-in unit is disposed on the second PCB board. The plug-in unit includes a pin. The first PCB board includes a plug-in hole configured to correspond with the pin of the plug-in unit. The first PCB board is attached to the plug-in unit via insertion of the pin into plug-in hole.

Compared with the prior art, the ground fault circuit interrupter of the disclosure has at least the following beneficial effects. First, the complex structure of leaf switch 18 is replaced with a contact conductive part having a simple structure disposed on the reset slider 22. Thus, a part having a complex structure is omitted from the ground fault circuit interrupter, thereby benefiting for production and assembly, and, further, improving the reliability and stability of the finished product.

Second, as the leaf switch 18 is omitted, a second PCB board 62, for example, may be disposed at the side of the first PCB board 61 where the leaf switch 18 was previously disposed. This improves the inner space utilization of the ground fault circuit interrupter and reduces the size of the ground fault circuit interrupter, making the ground fault circuit interrupter is more compact in structure and further easing its production and assembly.

BRIEF DESCRIPTION OF THE DRAWINGS

The accompanying drawings, which are incorporated in and constitute a part of this specification, illustrate the embodiments of the present disclosure and together with the description, serve to explain the principles of the invention.

DETAILED DESCRIPTION

Figure 1:
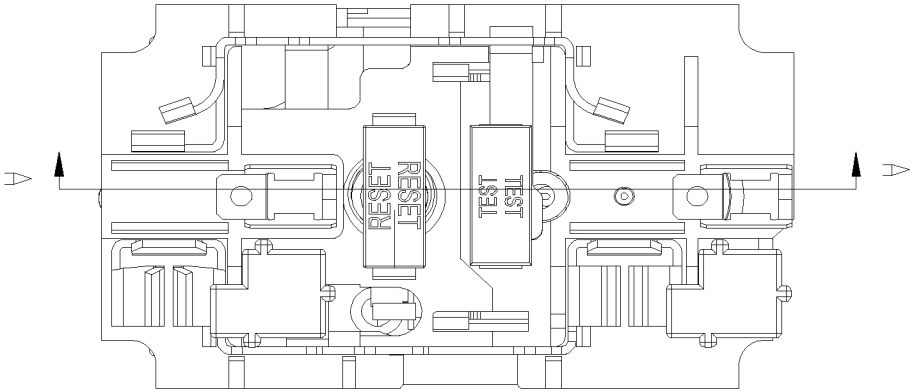
FIG. 1 PRIOR ART
FIG. 1 is a view of an existing ground fault circuit interrupter with a removed shell.
Figure 4:
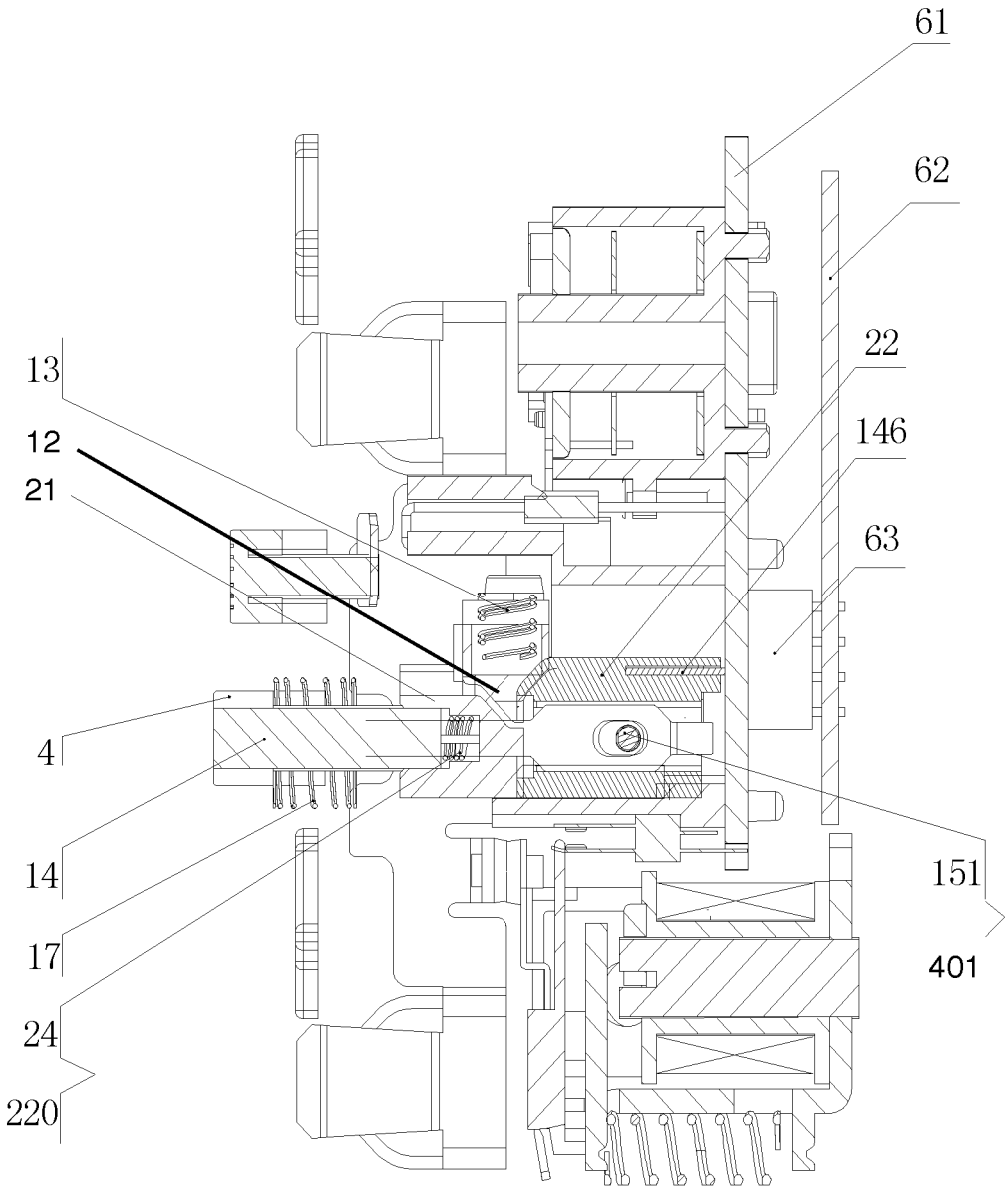
FIG. 4 is a cross-sectional view of an embodiment of a ground fault circuit interrupter of the present disclosure.
Figure 5:
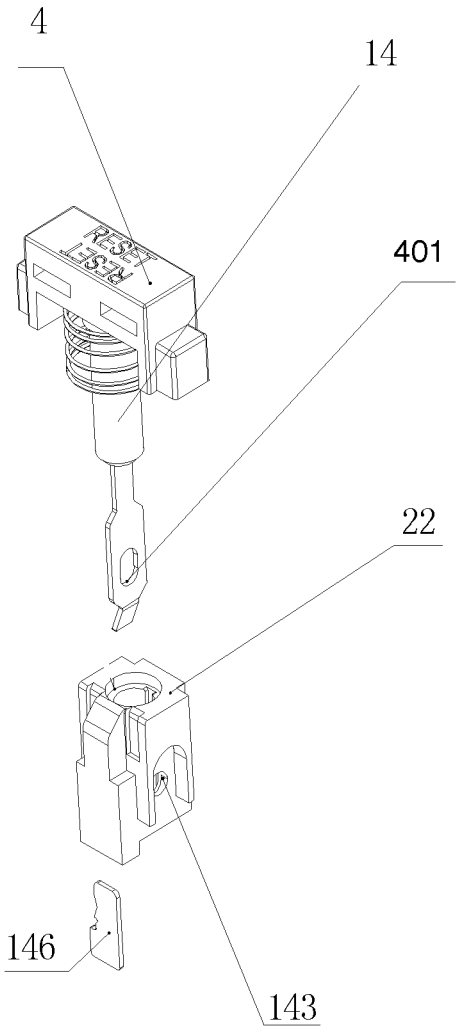
FIG. 5 is an exploded view of the reset mechanism of the ground fault circuit interrupter of FIG. 4.

References will now be made in detail to the present exemplary embodiments, examples of which are illustrated in the accompanying drawings. Wherever possible, the same reference numbers will be used throughout the drawings to refer to the same or like parts. While the description includes exemplary embodiments, other embodiments are possible, and changes may be made to the embodiments described without departing from the spirit and scope of the invention. The following detailed description does not limit the invention. Instead, the scope of the invention is defined by the appended claims and their equivalents As shown in FIGS. 4 and 5, a ground fault circuit interrupter of the disclosure may include a shell (not shown in the drawings), a reset key 4, a reset mechanism disposed in the shell, a conductive assembly connecting a power supply input side to a load side, a leakage signal detection circuit, and an electromagnetic tripping mechanism whose action is controlled by the leakage signal detection circuit. FIG. 1 also represents a front view of embodiments of the improved GFCI of this disclosure; FIG. 4 is view of embodiments of the improved GFCI of this disclosure along cross-section A-A.

The reset mechanism includes a reset support and a support return mechanism. The reset support includes a reset bracket 12 and a support reset spring 13 disposed in the reset bracket 12. The support return mechanism includes a reset pole 14, a reset key spring 17, a compression spring 24, a reset block 21 (not shown in FIG. 5), a compression spring container 220 in the reset block 21, a reset slider 22, and a contact conductive part. The reset slider 22 is disposed adjacent to and is configured to engage with the reset bracket 12.

The contact conductive part may be a contact copper sheet 146 and may be embedded at the lower end of the reset slider 22. Alternatively, the contact copper sheet 146 may be a conductive strip pasted at the lower end of the reset slider, or any other type of contact conductive part suitable for its disclosed purpose.

The contact conductive part may correspond to the position of switch contacts on a first PCB board 61, and may control the on-off state of the electrical connection of the conductive assembly by means of contact or separation with the switch contact. The switch contact and contact conductive part may be included in lieu of the leaf switch 18, discussed above.

Figure 2:
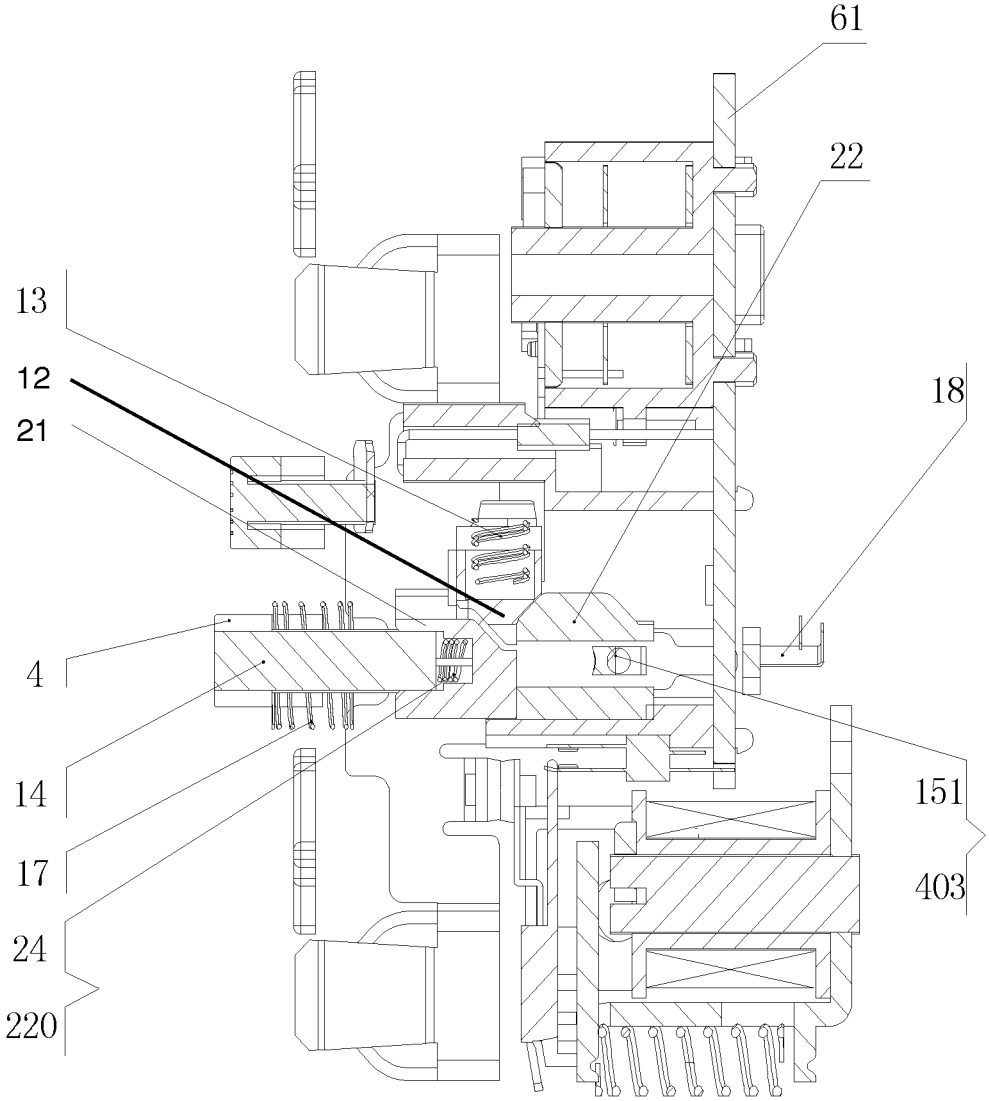
FIG. 2 PRIOR ART
FIG. 2 is a view along cross-section A-A of FIG. 1.
Figure 3:
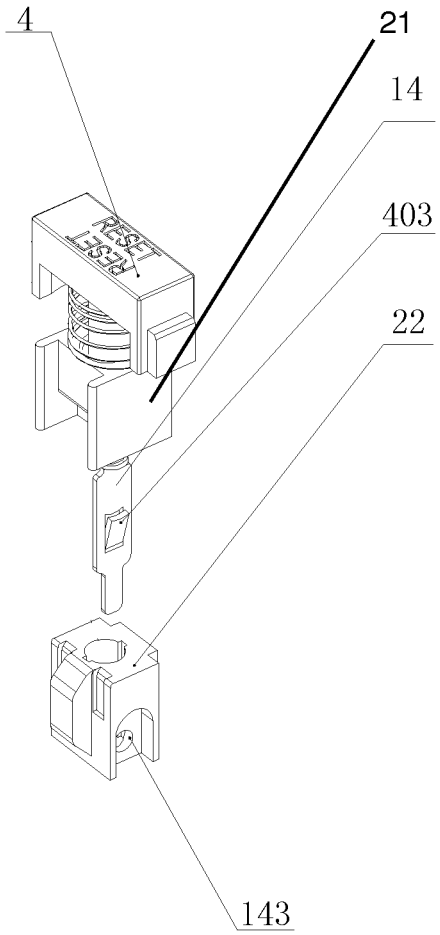
FIG. 3 PRIOR ART
FIG. 3 is an exploded view of the reset mechanism of an existing ground fault circuit interrupter.

The majority of structures of the disclosed reset support and the support return mechanism of FIGS. 4 and 5 are the same or substantially similar as those described above with respect to FIGS. 2 and 3. In addition to those features otherwise discussed herein, a primary difference between the existing ground fault circuit interrupter (FIGS. 1, 2, and 3 and that of the present disclosure (FIGS. 4 and 5) is that the reset pole 14 is shorter in length.

Referring back to FIGS. 4 and 5, under the action of the reset key, the support return mechanism, and the electromagnetic tripping mechanism, the reset support has a first position in a reset state and a second position in a tripping state as discussed above.

The reset support and support return mechanisms work similarly to those discussed above: From a tripped state, when the reset key 4 is pressed, the reset pole 14 moves downward (i.e., away from the reset key 4). Provided that adequate downward pressure is provided to the reset key 4, the reset pole 14 moves downward, compressing compression spring 24, and bringing a reset hole 401 (and/or a reset locking hook 403 as discussed above) at the lower end of the reset pole 14 into alignment with a linkage hole 143 on the reset slider 22. Upon such alignment, an iron core 151 of the electromagnetic tripping mechanism may engage with both the reset hole 401 (or hook 403) and the linkage hole 143 via an iron core reset spring 153 (not show). Engagement of the iron core 151 serves to lock the reset pole 14 and the reset slider 22 together, along with reset block 21.

Additionally, when reset key 4 is sufficiently pressed, the contact conductive part at the downward end of reset sliding block 22 is pressed against the switch contacts of the first PCB board 61, thereby connecting a reverse relay (not shown) that is preferably located on the first PCB board 61. As this reverse relay may control an on-off state of electrical connection of the conductive assembly from a power supply input side to a load side, the provision of power supply is prevented while reset key 4 is fully depressed. Once the reset key 4 is no longer pressed downward, key reset spring 17 returns reset key 4 to its original position, consequently pulling reset slider 22 with it. Thus, the contact conductive part is pulled off of the switch contacts of the first PCB board 61, permitting the reverse relay to disconnect.

As discussed in the referenced art, when the reset sliding block 22 is locked to reset pole 14 (and reset block 21) via an iron core 151 of an electromagnetic tripping mechanism and after reset key 4 is no longer being pressed, the support return mechanism moves upward due to the force of reset key spring 17 and the reset sliding block 22 presses against reset bracket 12, maintaining the reset support in the first position.

When the electromagnetic tripping mechanism is tripped, the iron core 151 of the electromagnetic tripping mechanism is withdrawn, thereby unlocking reset pole 14 and reset slider 22 (and reset block 21) from one another. This unlocking allows bracket reset spring 13 to push reset bracket 12 further in the direction of the support return mechanism, which disconnects the electrical contacts of reset bracket 12 and returns the rest support to the second (open) position. Under the force of the compression spring 24 and bracket reset spring 13 (transferred via corresponding inclined surfaces of reset bracket 12 and reset sliding block 22), the reset slider 22 and the reset block 21 both separate from one another, and move away from the reset key 4 along the reset pole 14.

As shown in FIG. 4, the ground fault circuit interrupter of the disclosure may be provided with a second PCB board 62. The second PCB board 62 may be disposed at one side of the first PCB board 61 of the ground fault circuit interrupter at a the position where the leaf switch 18 was disposed in existing ground fault circuit interrupters. That is, the second PCB board 62 may be disposed within the ground fault circuit interrupter in a position substantially parallel to the first PCB board 61 on the opposite side of the first PCB board 61 upon which the switch contact is disposed.

The second PCB board 62 may be connected to the first PCB board 61 by means of a plug-in unit 63. For example as shown in FIG. 4, the plug-in unit 63 may be disposed on the first PCB board 61, and the second PCB board 62 may implement the connection by means of matching between a plug-in hole (or plug in holes) correspondingly disposed thereon and a pin (or pins) of the plug-in unit 63.

In other embodiments, the plug-in unit 63 may be disposed on the second PCB board 62, and the first PCB board 61 may implement the connection by means of matching between a plug-in hole (or plug in holes) correspondingly disposed thereon and a pin (or pins) of the plug-in unit 63.

In the preceding specification, various preferred embodiments have been described with reference to the accompanying drawings. It will, however, be evident that various other modifications and changes may be made thereto, and additional embodiments may also be implemented, without departing from the broader scope of the invention as set forth in the claims that follow.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

We claim:

1. A ground fault circuit interrupter, comprising:

a reset key;

a reset mechanism;

a conductive assembly configured to connect a power supply input side to a load side;

a leakage signal detection circuit; and an electromagnetic tripping mechanism configured to be controlled by the leakage signal detection circuit, wherein:

the reset mechanism comprises a reset support and a support return mechanism;

the reset support comprises a reset bracket and a support reset spring disposed in the reset bracket;

the support return mechanism comprises a reset pole, a reset key spring, a compression spring, a reset block, a compression spring container, a reset slider, and a contact conductive part;

the reset slider is configured to engage with the reset bracket;

the reset support has a first position in a reset state and a second position in a tripping state;

the support return mechanism is engaged with the reset support such that the reset support is biased to slide from the first position to the second position;

the contact conductive part is disposed at a lower end of the reset slider and is configured to align with a position of a switch contact on a first PCB board;

the contact conductive part comprises a planar sheet with a length, a width, and a thickness, the length being disposed substantially perpendicular to the first PCB board; and a state of contact or separation between a lower edge of the planar sheet and the switch contact is configured to control an on-off state of the conductive assembly.

2. A ground fault circuit interrupter, comprising:

a reset key;

a reset mechanism;

a conductive assembly configured to connect a power supply input side to a load side;

a leakage signal detection circuit; and an electromagnetic tripping mechanism configured to be controlled by the leakage signal detection circuit, wherein:

the reset mechanism comprises a reset support and a support return mechanism;

the reset support comprises a reset bracket and a support reset spring disposed in the reset bracket;

the support return mechanism comprises a reset pole, a reset key spring, a compression spring, a reset block, a compression spring container, a reset slider, and a contact conductive part;

the reset slider is configured to engage with the reset bracket;

the reset support has a first position in a reset state and a second position in a tripping state;

the support return mechanism is engaged with the reset support such that the reset support is biased to slide from the first position to the second position;

the contact conductive part is disposed within a lower end of the reset slider and is configured to align with a position of a switch contact on a first PCB board;

a majority of surface area of the contact conductive part is constantly encased by the reset slider; and a state of contact or separation between the contact conductive part and the switch contact is configured to control an on-off state of the conductive assembly.

3. A ground fault circuit interrupter, comprising:

a reset key;

a reset mechanism;

a conductive assembly configured to connect a power supply input side to a load side;

a leakage signal detection circuit; and an electromagnetic tripping mechanism configured to be controlled by the leakage signal detection circuit, wherein:

the reset mechanism comprises a reset support and a support return mechanism;

the reset support comprises a reset bracket and a support reset spring disposed in the reset bracket;

the support return mechanism comprises a reset pole, a reset key spring, a compression spring, a reset block, a compression spring container, a reset slider, and exactly one contact conductive part;

the reset slider is configured to engage with the reset bracket;

the reset support has a first position in a reset state and a second position in a tripping state;

the support return mechanism is engaged with the reset support such that the reset support is biased to slide from the first position to the second position;

the exactly one contact conductive part is disposed at a lower end of the reset slider and is configured to align with a position of a switch contact on a first PCB board;

the exactly one contact conductive part includes a notched portion that is surrounded by the reset slider; and a state of contact or separation between the exactly one contact conductive part and the switch contact is configured to control an on-off state of the conductive assembly.

4. The ground fault circuit interrupter of claim 1, further comprising a second PCB board, wherein:

the second PCB board is positioned substantially parallel to the first PCB board on the opposite side of the first PCB board upon which the switch contact is disposed.

5. The ground fault circuit interrupter of claim 2, further comprising a second PCB board, wherein:

the second PCB board is positioned substantially parallel to the first PCB board on the opposite side of the first PCB board upon which the switch contact is disposed.

6. The ground fault circuit interrupter of claim 3, further comprising a second PCB board, wherein:

the second PCB board is positioned substantially parallel to the first PCB board on the opposite side of the first PCB board upon which the switch contact is disposed.

7. The ground fault circuit interrupter of claim 4, further comprising a plug-in unit, wherein plug-in unit connects the second PCB board and the first PCB board.

8. The ground fault circuit interrupter of claim 5, further comprising a plug-in unit, wherein plug-in unit connects the second PCB board and the first PCB board.

9. The ground fault circuit interrupter of claim 6, further comprising a plug-in unit, wherein plug-in unit connects the second PCB board and the first PCB board.

10. The ground fault circuit interrupter of claim 7, wherein:

the plug-in unit is disposed on the first PCB board;

the plug-in unit includes a pin;

the second PCB board includes a plug-in hole configured to correspond with the pin of the plug-in unit; and the second PCB board is attached to the plug-in unit via insertion of the pin into plug-in hole.

11. The ground fault circuit interrupter of claim 8, wherein:

the plug-in unit is disposed on the first PCB board;

the plug-in unit includes a pin;

the second PCB board includes a plug-in hole configured to correspond with the pin of the plug-in unit; and the second PCB board is attached to the plug-in unit via insertion of the pin into plug-in hole.

12. The ground fault circuit interrupter of claim 9, wherein:

the plug-in unit is disposed on the first PCB board;

the plug-in unit includes a pin;

the second PCB board includes a plug-in hole configured to correspond with the pin of the plug-in unit; and the second PCB board is attached to the plug-in unit via insertion of the pin into plug-in hole.

13. The ground fault circuit interrupter of claim 7, wherein:

the plug-in unit is disposed on the second PCB board;

the plug-in unit includes a pin;

the first PCB board includes a plug-in hole configured to correspond with the pin of the plug-in unit; and the first PCB board is attached to the plug-in unit via insertion of the pin into plug-in hole.

14. The ground fault circuit interrupter of claim 8, wherein:

the plug-in unit is disposed on the second PCB board;

the plug-in unit includes a pin;

the first PCB board includes a plug-in hole configured to correspond with the pin of the plug-in unit; and the first PCB board is attached to the plug-in unit via insertion of the pin into plug-in hole.

15. The ground fault circuit interrupter of claim 9, wherein:

the plug-in unit is disposed on the second PCB board;

the plug-in unit includes a pin;

the first PCB board includes a plug-in hole configured to correspond with the pin of the plug-in unit; and the first PCB board is attached to the plug-in unit via insertion of the pin into plug-in hole.

16. The ground fault circuit interrupter of claim 1, wherein the electronic tripping mechanism comprises an iron core that is configured to lock the reset slider to the reset pole.

17. The ground fault circuit interrupter of claim 2, wherein the electronic tripping mechanism comprises an iron core that is configured to lock the reset slider to the reset pole.

18. The ground fault circuit interrupter of claim 16, wherein the reset slider further comprises a linkage hole configured to receive the iron core.

19. The ground fault circuit interrupter of claim 17, wherein the reset slider further comprises a linkage hole configured to receive the iron core.

20. The ground fault circuit interrupter of claim 16, wherein the reset pole further comprises a reset hole configured to receive the iron core.

* * * * *